US012378493B1

(12) United States Patent
Field et al.

(10) Patent No.: US 12,378,493 B1
(45) Date of Patent: Aug. 5, 2025

(54) LUBRICATING COMPOSITION FOR ENHANCED FUEL ECONOMY

(71) Applicant: Afton Chemical Corporation, Richmond, VA (US)

(72) Inventors: Samuel Bruce Field, Windsor (GB); Paul Ransom, Huddersfield (GB)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 18/618,566

(22) Filed: Mar. 27, 2024

(51) Int. Cl.

| | |
|---|---|
| ***C10M 135/10*** | (2006.01) |
| ***C10M 135/18*** | (2006.01) |
| ***C10M 169/04*** | (2006.01) |
| *C10N 10/04* | (2006.01) |
| *C10N 10/12* | (2006.01) |
| *C10N 20/04* | (2006.01) |
| *C10N 30/00* | (2006.01) |
| *C10N 30/02* | (2006.01) |
| *C10N 30/04* | (2006.01) |
| *C10N 40/25* | (2006.01) |

(52) U.S. Cl.
CPC ..... *C10M 135/10* (2013.01); *C10M 135/18* (2013.01); *C10M 169/04* (2013.01); *C10M 2219/046* (2013.01); *C10M 2219/068* (2013.01); *C10N 2010/04* (2013.01); *C10N 2010/12* (2013.01); *C10N 2020/04* (2013.01); *C10N 2030/02* (2013.01); *C10N 2030/04* (2013.01); *C10N 2030/40* (2020.05); *C10N 2030/52* (2020.05); *C10N 2030/54* (2020.05); *C10N 2040/255* (2020.05)

(58) Field of Classification Search
CPC ..... C10M 135/10; C10M 135/18; C10M 169/04; C10M 2219/046; C10M 2219/068; C10N 2010/04; C10N 2010/12; C10N 2020/04; C10N 2030/02; C10N 2030/04; C10N 2030/40; C10N 2030/52; C10N 2030/54; C10N 2040/255
USPC ..... 508/390
See application file for complete search history.

(56) References Cited

U.S. PATENT DOCUMENTS

| | | | |
|---|---|---|---|
| 2,237,625 | A | 4/1941 | Olin |
| 2,237,627 | A | 4/1941 | Olin |
| 2,527,948 | A | 10/1950 | Lyon, Jr. et al. |
| 2,695,316 | A | 11/1954 | Mcbride |
| 2,995,569 | A | 8/1961 | Hamilton et al. |
| 3,022,351 | A | 2/1962 | Mihm et al. |
| 3,219,666 | A | 11/1965 | Norman et al. |
| 3,308,166 | A | 3/1967 | Biensan et al. |
| 3,392,201 | A | 7/1968 | Warner |
| 3,471,404 | A | 10/1969 | Myers |
| 3,502,677 | A | 3/1970 | Le Suer |
| 3,565,804 | A | 2/1971 | Honnen et al. |
| 3,634,515 | A | 1/1972 | Piasek et al. |
| 3,673,090 | A | 6/1972 | Waldbillig et al. |
| 3,697,429 | A | 10/1972 | Engel et al. |
| 3,697,574 | A | 10/1972 | Piasek et al. |
| 3,703,504 | A | 11/1972 | Horodysky |
| 3,703,505 | A | 11/1972 | Horodysky et al. |
| 3,736,357 | A | 5/1973 | Piasek et al. |
| 3,763,244 | A | 10/1973 | Shubkin |
| 3,796,661 | A | 3/1974 | Suratwala |
| 3,816,346 | A | 6/1974 | Coppock et al. |
| 3,873,454 | A | 3/1975 | Horodysky et al. |
| 3,991,056 | A | 11/1976 | Okamoto et al. |
| 4,036,771 | A | 7/1977 | Denis et al. |
| 4,118,329 | A | 10/1978 | Hotten |
| 4,119,549 | A | 10/1978 | Davis |
| 4,119,550 | A | 10/1978 | Davis et al. |
| 4,147,640 | A | 4/1979 | Jayne et al. |
| 4,191,659 | A | 3/1980 | Davis |
| 4,204,969 | A | 5/1980 | Papay et al. |
| 4,209,471 | A | 6/1980 | Dube et al. |
| 4,218,332 | A | 8/1980 | Schwab |
| 4,234,435 | A | 11/1980 | Meinhardt et al. |
| 4,240,958 | A | 12/1980 | Braid |
| 4,282,392 | A | 8/1981 | Cupples et al. |
| 4,285,822 | A | 8/1981 | deVries et al. |
| 4,344,854 | A | 8/1982 | Davis et al. |
| 4,472,306 | A | 9/1984 | Powers et al. |
| 4,537,696 | A | 8/1985 | Beimesch |
| 4,564,709 | A | 1/1986 | Koyama et al. |
| 4,587,368 | A | 5/1986 | Pratt |

(Continued)

FOREIGN PATENT DOCUMENTS

| | | | |
|---|---|---|---|
| EP | 0088453 | A1 | 9/1983 |
| EP | 0612839 | A1 | 8/1994 |
| EP | 1788068 | A1 | 5/2007 |
| EP | 2639433 | A1 | 9/2013 |
| GB | 961009 | A | 6/1964 |
| GB | 1162334 | A | 8/1969 |
| JP | 2014152301 | A | 8/2014 |
| JP | 2016534216 | A | 11/2016 |
| JP | 2017514984 | A | 6/2017 |
| JP | 2017149830 | A | 8/2017 |
| JP | 201821107 | A | 2/2018 |

(Continued)

OTHER PUBLICATIONS

Takeuchi et al., Investigation of Engine Oil Effect on Abnormal Combustion in Turbocharged Direct Injection-Spark Ignition Engines, SAE Int., Nov. 2012, vol. 5, Issue 3. (Abstract).
Haenel et al., Systematic Approach to Analyze and Characterize Pre-ignition Events in Turbocharged Direct-injected Gasoline Engines, SAE Int., Apr. 2011. (Abstract).
W. W. Yau, J. J. Kirkland and D. D. Bly, "Modern Size Exclusion Liquid Chromatography", John Wiley and Sons, New York, 1979.

*Primary Examiner* — Prem C Singh
*Assistant Examiner* — Francis C Campanell
(74) *Attorney, Agent, or Firm* — Honigman LLP

(57) ABSTRACT

The present disclosure relates to passenger car engine lubricating oil compositions and methods of lubricating a crankcase of a passenger car engine with such lubricating oil compositions effective to achieve fuel economy improvement when using select calcium sulfonate-based compounds combined with one or more oil-soluble molybdenum compounds in ultra-low viscosity engine oils.

19 Claims, No Drawings

(56) References Cited

U.S. PATENT DOCUMENTS

| | | | |
|---|---|---|---|
| 4,636,322 | A | 1/1987 | Nalesnik |
| 4,711,736 | A | 12/1987 | Horodysky et al. |
| 4,747,971 | A | 5/1988 | Erdman |
| 4,795,576 | A | 1/1989 | Born et al. |
| 4,857,214 | A | 8/1989 | Papay et al. |
| 4,925,983 | A | 5/1990 | Steckel |
| 4,941,984 | A | 7/1990 | Chamberlin, III et al. |
| 4,954,274 | A | 9/1990 | Zaweski et al. |
| 4,956,122 | A | 9/1990 | Watts et al. |
| 4,966,720 | A | 10/1990 | DeGonia et al. |
| 4,992,183 | A | 2/1991 | Beimesch et al. |
| 5,089,156 | A | 2/1992 | Chrisope et al. |
| 5,114,602 | A | 5/1992 | Petrille et al. |
| 5,266,223 | A | 11/1993 | Song et al. |
| 5,614,480 | A | 3/1997 | Salomon et al. |
| 5,627,259 | A | 5/1997 | Thaler et al. |
| 5,633,326 | A | 5/1997 | Patil et al. |
| 5,643,859 | A | 7/1997 | Gutierrez et al. |
| 5,792,729 | A | 8/1998 | Harrison et al. |
| 5,851,965 | A | 12/1998 | Harrison et al. |
| 5,853,434 | A | 12/1998 | Harrison et al. |
| 5,936,041 | A | 8/1999 | Diana et al. |
| 6,124,247 | A | 9/2000 | Cazin et al. |
| 6,303,546 | B1 | 10/2001 | Hata et al. |
| 8,260,530 | B2 | 9/2012 | Rollinger et al. |
| 8,327,687 | B2 | 12/2012 | Amann et al. |
| 8,543,315 | B2 | 9/2013 | Glugla et al. |
| 9,481,696 | B1 | 11/2016 | Edwards et al. |
| 10,829,713 | B2 | 11/2020 | Abraham et al. |
| 11,034,912 | B2 | 6/2021 | Ritchie et al. |
| 11,214,750 | B2 | 1/2022 | Milner |
| 2002/0165102 | A1 | 11/2002 | Hata et al. |
| 2003/0153469 | A1 | 8/2003 | Ozbalik |
| 2004/0242434 | A1 | 12/2004 | Yagishita et al. |
| 2005/0101496 | A1 | 5/2005 | Loper et al. |
| 2006/0058200 | A1 | 3/2006 | Shaw et al. |
| 2006/0217271 | A1 | 9/2006 | Brown et al. |
| 2007/0184992 | A1 | 8/2007 | Takeuchi et al. |
| 2008/0128184 | A1 | 6/2008 | Loper et al. |
| 2009/0156446 | A1 | 6/2009 | McAtee et al. |
| 2011/0111997 | A1 | 5/2011 | Cook et al. |
| 2011/0213538 | A1 | 9/2011 | Amann et al. |
| 2011/0265761 | A1 | 11/2011 | Amann et al. |
| 2012/0029789 | A1 | 2/2012 | Mehta et al. |
| 2012/0101017 | A1 | 4/2012 | Duggal |
| 2012/0186225 | A1 | 7/2012 | Amann et al. |
| 2013/0035841 | A1 | 2/2013 | Glugla et al. |
| 2015/0322367 | A1 | 11/2015 | Patel et al. |
| 2015/0322369 | A1 | 11/2015 | Patel et al. |
| 2016/0230116 | A1 | 8/2016 | Mosier et al. |
| 2016/0281020 | A1 | 9/2016 | Yamamoto et al. |
| 2017/0015926 | A1 | 1/2017 | Fletcher et al. |
| 2017/0015930 | A1 | 1/2017 | Fletcher |
| 2017/0022441 | A1 | 1/2017 | Onodera |
| 2017/0101598 | A1* | 4/2017 | Cant ..... C10M 135/10 |
| 2018/0002631 | A1 | 1/2018 | Milner |
| 2019/0284495 | A1 | 9/2019 | Abraham et al. |
| 2021/0371767 | A1 | 12/2021 | Shimizu et al. |

FOREIGN PATENT DOCUMENTS

| | | | | |
|---|---|---|---|---|
| JP | 2018168344 | A | 11/2018 | |
| WO | 2009104682 | A1 | 8/2009 | |
| WO | WO-2013074498 | A1 * | 5/2013 | ..... C10M 167/00 |
| WO | 2015023559 | A1 | 2/2015 | |
| WO | 2015042337 | A1 | 3/2015 | |
| WO | 2015042340 | A1 | 3/2015 | |
| WO | 2015042341 | A1 | 3/2015 | |
| WO | 2015076417 | A1 | 5/2015 | |
| WO | 20150114920 | A1 | 8/2015 | |
| WO | 2017011691 | A1 | 1/2017 | |
| WO | 2020085228 | A1 | 4/2020 | |

* cited by examiner

LUBRICATING COMPOSITION FOR ENHANCED FUEL ECONOMY

TECHNICAL FIELD

The present disclosure relates to lubricating compositions and, in particular, lubricating compositions exhibiting improved fuel economy.

BACKGROUND

Automotive manufacturers continue to push for improved efficiency, fluid longevity, and fuel economy, and as such, demands on engines, lubricants, and their components continue to increase. Today's engines are often smaller, lighter and more efficient with technologies designed to improve fuel economy, performance, and power. These requirements also mean engine oil performance must evolve to meet the higher demands of such modern engines and their corresponding performance criteria tied to their unique use and applications. With such exacting demands for engine oils, lubricant manufacturers often tailor lubricants and their additives to meet certain performance requirements for industry and/or manufacturer applications.

Typically, industry standards and/or automotive manufacturers require certain performance such that a lubricant designed for one use or application may not satisfy all the requirements for a different use or application. For example, there are often tradeoffs in engine oil performance between fuel economy and other performance requirements. Fuel economy can be evaluated, for example, through evaluations set by the Japanese Automotive Standards Organization (JASO) with the JASO M 366 fired engine fuel economy test and/or the JASO M 365 motored engine fuel economy test. Previously, it was generally understood that use of additives based on salicylate chemistry tended to result in lubricants having lower friction coefficients and/or improved surface-active functionality that was expected to provide benefits in terms of fuel economy and cleanliness when compared to other detergent chemistries. However, advancements in lubricant formulations and component interactions have created shortcomings of prior salicylate additive chemistry in the context of achieving improved fuel efficiency in ultra-low viscosity engine oil compositions.

SUMMARY

The present disclosure relates to engine lubricating oil compositions and methods of lubricating an engine crankcase of a passenger car engine with the lubricating oil composition to achieve a positive fuel economy increase when fuel economy is measured pursuant to one or both of JASO M 366 and/or JASO M 365. In one approach or embodiment, a method of improving the fuel economy of a passenger car engine using a lubricating oil composition is provided herein. In aspects of this approach or embodiment, the methods herein include lubricating an engine crankcase of a passenger car engine with a lubricating oil composition and achieving a positive fuel economy increase when fuel economy is measured pursuant to one or both of JASO M 366 and/or JASO M 365; wherein the lubricating oil composition includes (i) at least one calcium-containing hydrocarbyl-substituted sulfonate compound providing about 900 ppm or more calcium to the lubricating oil composition and wherein the lubricating oil composition is essentially devoid of sulfur-free detergents, (ii) at least one oil soluble molybdenum compound providing about 500 to about 1200 ppm molybdenum to the lubricating oil composition; (iii) an amount of ash-containing additives to provide a total measured sulfated ash about 0.8 weight percent or less as measured pursuant to ASTM D874; (iv) a total base number (TBN) of the lubricating oil composition, measured pursuant to ASTM D2896, of at least about 6.0 mg KOH/gram; and (v) a high temperature high shear viscosity as measured pursuant to ASTM D4683 at 150° C. of about 1.7 to about 2.9 cSt.

In other approaches or embodiments, the methods as described in the previous paragraph may include one or more other features, steps, or embodiments in any combination. These other features, steps, or embodiments include one or more of the following: wherein the lubricating oil composition has a positive fuel economy increase as measured pursuant to JASO M 366 of greater than 1.1%; and/or wherein the lubricating oil composition has a positive fuel economy increase as measured pursuant to JASO M 365 of greater than 1.5% (Japanese WLTC Mode); and/or wherein the calcium-containing hydrocarbyl-substituted sulfonate compound provides up to about 1500 ppm of calcium; and/or wherein the calcium-containing hydrocarbyl-substituted sulfonate compound has a total base number (TBN) measured pursuant to ASTM D2896 of at least about 175 mg KOH/gram; and/or wherein the calcium-containing hydrocarbyl-substituted sulfonate compound includes a hydrocarbyl moiety thereof having a number average molecular weight of about 80 to 300 g/mol; and/or wherein the hydrocarbyl moiety of the calcium-containing hydrocarbyl-substituted sulfonate component includes a linear or branched C6 to C30 hydrocarbyl group; and/or wherein the sulfur-free detergent includes a metal-containing salicylate detergent; and/or wherein the lubricating oil composition has a weight ratio of calcium-to-molybdenum of about 1:1 to about 2:1; and/or wherein the oil-soluble molybdenum compound is selected from molybdenum dithiocarbamates, molybdenum dialkyl dithiophosphates, molybdenum sulfides, molybdenum disulfides, molybdenum dithiophosphinates, amine salts of molybdenum compounds, organomolybdenum nitrogen complexes, molybdenum xanthates, molybdenum thioxanthates, molybdenum sulfides, molybdenum carboxylates, molybdenum alkoxides, a trinuclear organo-molybdenum compound, complexes thereof, esters thereof, and/or mixtures thereof; and/or wherein the lubricating oil composition has a weight ratio of calcium-to-molybdenum of about 1:1 to about 2:1; and/or wherein the lubricating oil composition is essentially devoid of metal salts of phenates, calixarates, salixarates, salicylates, carboxylic acids, or combinations thereof; and/or wherein the lubricating oil composition is substantially free of organic friction modifiers; and/or wherein the lubricating oil composition has a KV100 of about 8 cSt or lower (or about 7.8 cSt or lower, about 7.4 cSt, or lower, or about 7.0 cSt or lower).

In yet another approach or embodiment, a passenger car engine lubricating oil composition is described herein wherein the composition has componentry and relationships of such componentry configured to achieve positive fuel economy improvement pursuant to JASO M 366 and/or JASO M 365. In aspect of this approach or embodiment, the composition include at least one calcium-containing hydrocarbyl-substituted sulfonate compound providing about 900 ppm or more calcium to the lubricating oil composition and wherein the lubricating oil composition is essentially devoid of sulfur-free detergents; at least one oil soluble molybdenum compound providing about 500 to about 1200 ppm molybdenum to the lubricating oil composition; an amount of ash-contributing additives to provide a total measured sulfated ash about 0.8 weight percent or less as measured pursuant to ASTM D874; a total base number (TBN) of the lubricating oil composition, measured pursuant to ASTM D2896, of at least about 6.0 mg KOH/gram; a high temperature high shear viscosity as measured pursuant to ASTM D4683 at 150° C. of about 1.7 to about 2.9 cSt; and wherein the lubricating oil composition has a weight ratio of calcium-to-molybdenum of about 1:1 to about 2:1.

In yet other approaches or embodiments, the lubricating oil composition as described in the previous paragraph includes other features or embodiment in any combination. These other features or embodiment include one or more of the following (and/or may include any feature or embodiment of the lubricating oil compositions as described above with respect to the methods): wherein the lubricating oil composition has a positive fuel economy increase as measured pursuant to JASO M 366 of greater than 1.1%; and/or wherein the lubricating oil composition has a positive fuel economy increase as measured pursuant to JASO M 365 of greater than 1.5% (Japanese WLTC Mode); and/or wherein the calcium-containing hydrocarbyl-substituted sulfonate compound provides up to about 1500 ppm of calcium; and/or wherein the calcium-containing hydrocarbyl-substituted sulfonate compound includes a hydrocarbyl moiety thereof having a number average molecular weight of about 80 to 300 g/mol and derived from C14 to C30 olefins.

In yet other approaches or embodiments, the present disclosure provides for the use of any embodiment of the lubricating oil compositions as described in this Summary for achieving a positive fuel economy increase as measured pursuant to JASO M 366 of greater than 1.1%; and/or for achieving a positive fuel economy increase as measured pursuant to JASO M 365 of greater than 1.5% (Japanese WLTC Mode) when the lubricating oil compositions lubricate the crankcase of a passenger car engine.

DETAILED DESCRIPTION

The present disclosure relates to passenger car engine lubricating oil compositions and methods of lubricating a crankcase of a passenger car engine (preferably, a spark-ignition or gasoline-fueled engine) with such lubricating oil compositions to achieve fuel economy improvements when using select calcium sulfonate-based compounds combined with one or more oil-soluble molybdenum compounds in ultra-low viscosity engine oils (e.g., lubricating oil compositions having a high temperature high shear viscosity at 150° C. of about 2.9 cSt or lower and/or a KV100 viscosity of about 8 cSt or lower). The Japanese Automotive Standards Organization (JASO) has published standards and test procedures for evaluating fuel economy of automobile gasoline engine lubricating oils. As noted in the Background, the JASO M 365 standard evaluates fuel economy improvement in a motored engine test relative to a reference oil, and the JASO M 366 standard evaluates fuel economy improvement in a fired engine test relative to a reference oil. It was previously expected that additives utilizing a salicylate chemistry would provide the most robust option in achieving improved fuel economy in such tests. However, it was unexpectedly discovered that lubricant compositions including at least one calcium-containing hydrocarbyl-substituted sulfonate compound combined with one or more oil soluble molybdenum compounds achieved better fuel economy improvement in one or both of the M 365 and/or M 366 tests as compared to compositions utilizing the prior salicylate chemistry.

In one aspect, the methods and the passenger car engine lubricating oil compositions used in the methods herein have a composition and certain component relationships effective to achieve a positive fuel economy increase as measured pursuant one or both of JASO M 365 and/or M 366, and in particular, a fuel economy improvement as measured pursuant to JASO M 365 of greater than 1.4 percent (or 1.5 percent in the Japanese WLTC Mode) and/or a fuel economy improvement as measured pursuant to M 366 of greater than 1.1 percent (FEI adjusted). In some approaches, the methods and the passenger car engine lubricating oil compositions of the methods herein also have a composition effective to provide a high temperature high shear (HTHS) Viscosity at 150° C. of about 1.7 to about 2.9 cSt when measured pursuant to ASTM D4683 (in other approaches, about 2.3 to about 2.8 cSt or about 2.4 to about 2.8 cSt) and/or an ultra-low KV100 viscosity of 8 cSt or lower when measured per ASTM D445 (in other approaches, about 7.8 cSt or lower, about 7.6 cSt or lower, or about 7.4 cSt or lower).

In one approach or embodiment, the methods and the lubricating oil compositions of the methods described herein have select compositions utilizing one or more sulfonate-based compounds to provide the methods of improving fuel economy when combined with select oil-soluble molybdenum compounds. In one aspect, the present disclosure provides for methods of improving the fuel economy of a passenger car engine (preferably, a spark-ignition engine or a gasoline engine) using a lubricating oil composition where the method includes lubricating an engine crankcase of the passenger car engine with the lubricating oil composition and achieving a positive fuel economy increase when fuel economy is measured pursuant to one or both of JASO M 366 and/or JASO M 365. In one approach, the lubricating oil composition includes (i) at least one calcium-containing hydrocarbyl-substituted sulfonate compound providing about 900 ppm or more calcium to the lubricating oil composition and wherein the lubricating oil composition is essentially devoid of sulfur-free detergent additives (e.g., less than about 100 ppm of sulfur-free detergent additives, preferably, less than about 50 ppm of sulfur-free detergent additives, more preferably, less than about 20 ppm of sulfur-free detergent additives, and more preferably, no functional amounts of sulfur-free detergent additives), (ii) at least one oil-soluble molybdenum compound providing about 500 to about 1200 ppm molybdenum to the lubricating oil composition; (iii) an amount of ash-contributing additives to provide about 0.8 weight percent or less of total measured sulfated ash as measured pursuant to ASTM D874; (iv) a total base number (TBN) of the lubricating oil composition measured pursuant to ASTM D2896 of at least about 6.0 mg KOH/gram; and (v) a high temperature high shear viscosity as measured pursuant to ASTM D4683 at 150° C. of about 1.7 to about 2.9 cSt. As shown in the Examples herein, such methods of using the lubricating oil compositions herein result in a positive fuel economy increase as measured pursuant to JASO M 366 of greater than 1.1% (FEI adjusted) and/or a positive fuel economy increase as measured pursuant to JASO M 365 of greater than 1.4% (or at least about 1.5% when measured in the Japanese WLTC Mode). Methods and compositions including additives using the prior salicylate-based compounds could not achieve such performance in the M 366 and/or M 365 tests. As discussed more below, sulfur-free detergent additives generally comprise metal-containing salicylate-based compound(s), and the methods and lubricants herein are essentially devoid of such chemistry (e.g., less than about 100 ppm of metal-containing salicylate-based compound(s), preferably, less than about 50 ppm of metal-containing salicylate-based compound(s), more preferably, less than about 20 ppm of metal-containing salicylate-based compound(s), and more preferably, no functional amounts of metal-containing salicylate-based compound(s)).

As discussed more below, embodiments of the methods and the engine lubricating oil compositions of the methods herein achieve such performance through selection of one or more of specific additives utilizing particular sulfonate-based chemistry, being essentially devoid of salicylate chemistry (and, in some approaches, essentially devoid of other metalized detergent compounds such as magnesium, sodium, and the like), and in other embodiments, when combined with select oil-soluble molybdenum compounds providing certain amounts of calcium and molybdenum to the fluids having an ultra-low viscosity. In some exemplary approaches, the methods and the lubricating oil compositions of the methods herein have an additive package contributing about 900 ppm or more of calcium (preferably, about 900 to about 1500 ppm of calcium) provided by the selected sulfonate-based compounds and 500 to about 1200 ppm of molybdenum (preferably, about 500 to about 1000 ppm of molybdenum) from one or more selected oil-soluble molybdenum compounds. In some approaches, the methods and compositions herein also have a weight ratio of calcium-to-molybdenum of about 1:1 to about 2:1 (preferably, about 1.2 to about 1.9). Further details on the lubricant componentry and additive packages is provided below and shown in the Examples herein.

Hydrocarbyl-Substituted Sulfonate-Based Compounds

The methods and the passenger car engine lubricating oil compositions of the methods herein include use of select compounds based on sulfonate chemistry and, in particular, one or more calcium-containing hydrocarbyl-substituted sulfonate compounds configured to improve fuel economy when, for instance, such sulfonate compounds are combined with the one or more oil-soluble molybdenum compounds.

In one approach or embodiment, suitable calcium-containing hydrocarbyl-substituted sulfonate compounds include those with a linear or branched hydrocarbyl substituent having a number average molecular weight of about 80 to about 300 g/mol (in other approaches, about 100 to about 300 g/mol, about 200 to about 300 g/mol, or about 225 to about 300 g/mol), and in particular, a hydrocarbyl substituent having a linear or branched C6 to C30 hydrocarbyl group and, in some approaches, derived from a blend of C14 to C26 olefins. Preferably, the calcium-containing hydrocarbyl-substituted sulfonate compounds are used in the methods and the compositions herein at amounts to provide about 900 ppm or more calcium to the lubricants, and more preferably, about 900 ppm to about 1500 ppm of calcium to the lubricants. In other approaches, the calcium-containing hydrocarbyl-substituted sulfonate compounds are considered overbased and, in this context, have a total base number (TBN) of at least about 175 mg KOH/gram, and in other approaches, about 175 mg KOH/gram to about 500 mg KOH/gram (or in yet other approaches, about 200 to about 450 mg KOH/gram, about 250 to about 425 mg KOH/gram, or about 300 to about 425 mg KOH/gram) as measured pursuant to ASTM D2896. In other approaches, the sulfonate compounds herein may have a calcium-to-sulfonate ratio of about 1.1:1 or less, about 2:1 or less, about 4:1 or less, about 5:1 or less, about 7:1 or less, about 10:1 or less, about 12:1 or less, about 15:1 or less, about 20:1 or less.

In approaches, suitable calcium-containing hydrocarbyl-substituted sulfonate compounds herein may have about 0.5 to about 4 weight percent sulfur (in other approaches, about 1 to about 2 weight percent sulfur content, or about 1.2 to about 2 weight percent sulfur.) To this end, the calcium-containing hydrocarbyl-substituted sulfonate compounds may also provide about 1 percent to about 15 weight percent of the total sulfur in the finished lubricant (or in other approaches, about 5 to 10 weight percent of the total sulfur in the finished lubricant).

In yet other approaches, the above described TBN values of the sulfonate compounds herein reflect those of finished sulfonate compounds that have been diluted in a base oil. In other embodiments, the TBN of the sulfonate compounds herein may reflect a neat or non-diluted version of the sulfonate component. In such context, for example, the calcium sulfonate compounds, as a neat additive, have a TBN of about 300 to about 450 mg KOH/g, and in other approaches, about 380 to about 420 mg KOH/g as measured pursuant to ASTM D2896.

In embodiments, suitable sulfonate-based compounds are provided in the form of alkali or alkaline metal salts of hydrocarbyl sulfonates and, more particularly, the sulfonate-based compounds may include linear or branched alkali or alkaline earth metal salts (preferably calcium) of petroleum sulfonic acids and long chain mono- or di-alkylaryl sulfonic acids with the aryl group being benzyl, tolyl, and xylyl having the alkyl or hydrocarbyl substituent mentioned above (see, e.g., U.S. Pat. No. 7,732,390 and references cited therein, which are incorporated herein by reference). In one approach, the sulfonate compounds may be prepared by reacting a metal oxide or metal hydroxide with a suitable sulfonate substrate and carbon dioxide gas. The substrate is typically an acid, for example, an acid such as an aliphatic substituted sulfonic acid.

In other embodiments or approaches, the compositions and additive packages herein are also essentially devoid of (e.g., have little to no amounts of) other metalized salts such as phenates, calixarates, salixarates, salicylates, carboxylic acids, sulfurized derivatives thereof, or combinations thereof. As used herein, essentially devoid of means the compositions herein have less than about 100 ppm of phenates, calixarates, salixarates, salicylates, carboxylic acids, sulfurized derivatives thereof, or combinations; preferably, less than about 50 ppm of phenates, calixarates, salixarates, salicylates, carboxylic acids, sulfurized derivatives thereof, or combinations thereof; more preferably, less than about 20 ppm of phenates, calixarates, salixarates, salicylates, carboxylic acids, sulfurized derivatives thereof, or combinations thereof; and most preferably, no functional amounts of phenates, calixarates, salixarates, salicylates, carboxylic acids, sulfurized derivatives thereof, or combinations thereof.

In some approaches or embodiments, the methods and the lubricant compositions of the methods herein may include about 0.1 to about 5 weight percent of the calcium-containing hydrocarbyl-substituted sulfonate compounds, and in other approaches, about 0.15 to about 3 weight percent, and in yet other approaches, about 0.15 to 2.6 weight percent of the calcium-containing hydrocarbyl-substituted sulfonate compounds so long as the calcium-containing hydrocarbyl-substituted sulfonate compounds meet the calcium amounts, TBN, SASH, and other relationships noted herein.

Oil Soluble Molybdenum Compounds

In some approaches, the methods and the engine lubricating oil compositions of the methods herein include one or more oil soluble molybdenum-containing compounds. The oil-soluble molybdenum compound may be any of molybdenum dithiocarbamates, molybdenum dialkyl dithiophosphates, molybdenum sulfides, molybdenum disulfides, molybdenum dithiophosphinates, amine salts of molybdenum compounds, organomolybdenum nitrogen complexes, molybdenum xanthates, molybdenum thioxanthates, molybdenum sulfides, molybdenum carboxylates, molybdenum alkoxides, a trinuclear organo-molybdenum compound, and/or mixtures thereof. The molybdenum-containing compounds may be sulfur-containing or sulfur-free compounds. The molybdenum disulfide may be in the form of a stable dispersion.

In one embodiment the oil-soluble molybdenum compound may be selected from the group of molybdenum dithiocarbamates, molybdenum dialkyldithiophosphates, sulfur-free organomolybdenum complexes of organic amides, organomolybdenum nitrogen complexes, and mixtures thereof. In one embodiment, the oil-soluble molybdenum compound may be a molybdenum dithiocarbamate. In yet further embodiments, the oil-soluble molybdenum compound may be a molybdenum dialkyl dithiocarbamate compound and/or an organomolybdenum nitrogen complex providing the total the total amount of molybdenum to the lubricating compositions herein. Exemplary sulfur-free organomolybdenum complexes of organic amides are disclosed in U.S. Pat. No. 5,137,647.

In one approach or embodiment, suitable molybdenum dithiocarbamates may be represented by the Formula:

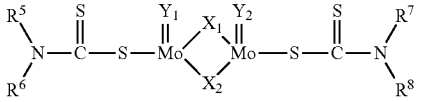

where $R^5$, $R^6$, $R^7$, and $R^8$ are each, independently, a hydrogen atom, a $C_1$ to $C_{20}$ alkyl group, a $C_6$ to $C_{20}$ cycloalkyl, aryl, alkylaryl, or aralkyl group, or a $C_3$ to $C_{20}$ hydrocarbyl group optionally containing an ester, ether, alcohol, or carboxyl group; and $X_1$, $X_2$, $Y_1$, and $Y_2$ are each, independently, a sulfur or oxygen atom. Examples of suitable groups for each of $R^5$, $R^6$, $R^7$, and $R^8$ include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. In other approaches, $R^5$, $R^6$, $R^7$, and $R^8$ may each have $C_6$ to $C_{18}$ alkyl groups (preferably, independently, a $C_6$ to $C_8$ alkyl group and/or a $C_{10}$ to $C_{14}$ alkyl group) and, in other approaches, one of $R^5$ and $R^6$ is a linear or branched $C_6$ to C& alkyl chain with the other of $R^5$ and $R^6$ being a linear or branched $C_{10}$ to $C_{14}$ alkyl chain combined with one of $R^7$ and $R^8$ is a linear or branched $C_6$ to $C_8$ alkyl chain with the other of $R^7$ and $R^8$ being a linear or branched $C_{10}$ to $C_{14}$ alkyl chain. $X_1$ and $X_2$ may be the same, and $Y_1$ and $Y_2$ may be the same. $X_1$ and $X_2$ may both comprise sulfur atoms, and $Y_1$ and $Y_2$ may both comprise oxygen atoms. Further examples of molybdenum dithiocarbamates include $C_6$-$C_{18}$ dialkyl or diaryldithiocarbamates, or alkyl-aryldithiocarbamates such as dibutyl-, diamyl-di-(2-ethylhexyl)-, dilauryl-, diolcyl-, and dicyclohexyl-dithiocarbamate.

Suitable examples of molybdenum compounds which may be used include commercial materials sold under the trade names such as Molyvan® 822, Molyvan® A, Molyvan® 2000. Molyvan® 807 and Molyvan® 855 from R. T. Vanderbilt Co., Ltd., and Sakura-Lube™ S-165, S-200, S-300, S-310G, S-525, S-600, S-700, and S-710 available from Adeka Corporation, and mixtures thereof. Suitable molybdenum components are described in U.S. Pat. Nos. 5,650,381; RE 37,363 E1; RE 38,929 E1; and RE 40,595 E1, incorporated herein by reference in their entireties.

In one embodiment and, if included in the formulations, the molybdenum compound may be present in the methods and the engine lubricating oil composition of the methods herein in an amount to provide about 500 to about 1200 ppm of molybdenum and, in other approaches, about 500 to about 1000 ppm of molybdenum. As noted above, the methods and compositions of the methods herein may have a weight ratio of the calcium from the at least one calcium-containing hydrocarbyl-substituted sulfonate compound to the molybdenum of about 1:1 to about 2:1, and in other approaches, about 1.2 to about 1.9.

Base Oil or Base Oil Blend:

The base oil used in the lubricating compositions and methods herein may be oils of lubricating viscosity and selected from any of the base oils in API Groups I to V as specified in the American Petroleum Institute (API) Base Oil Interchangeability Guidelines. Preferably, the one or more base oils have a combined base oil viscosity (BOV) of less than or equal to about 5.4 cSt at 100° C. In some approaches, the one or more base oils of lubricating viscosity is selected from an API group II base oil, an API Group III base oil, an API Group IV base oil, or mixtures thereof. In yet other approaches, the one or more base oils of lubricating viscosity is a gas-to-liquid (GTL) derived base oil, preferably a GTL base oil having a viscosity at 100° C. of about 4 to about 8 cSt. In some approaches or embodiments, the combined base oil viscosity (BOV) of the base oil blends herein at 100° C. may be about 5.4 cSt or less, about 5.2 cSt or less, about 5.1 cSt or less, about 5.0 cSt or less, about 4.8 cSt or less, about 4.5 cSt or less, or about 4.2 cSt or less. In other approaches, the combined base oil viscosity of the base oil blends herein is at least about 3 cSt, at least about 3.2 cSt, at least about 3.4 cSt, at least about 3.6 cSt, or at least about 3.8 cSt. The five base oil groups are generally set forth in Table 1 below:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Group II+ may comprise high viscosity index Group II.

The base oil blend used in the disclosed lubricating oil composition may be a mineral oil, animal oil, vegetable oil, synthetic oil, synthetic oil blends, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propyleneisobutylene copolymers); poly(l-hexenes), poly(l-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV, a Group V, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group II, a Group III, a Group IV, a Group V, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

The base oil systems herein, in some approaches or embodiments, include one or more of a Group I to Group V base oils and may have a KV100 of about 2 to about 20 cSt, in other approaches, about 2 to about 10 cSt, about 2.5 to about 6 cSt, in yet other approaches, about 2.5 to about 3.5 cSt, and in other approaches about 2.5 to about 4.5 cSt.

As used herein, the terms "oil composition," "lubrication composition," "lubricating oil composition," "lubricating oil," "lubricant composition," "fully formulated lubricant composition," "lubricant," and "lubricating and cooling fluid" are considered synonymous, fully interchangeable terminology referring to the finished lubrication product comprising a major amount of a base oil component plus minor amounts of the detergents and the other optional components.

Engine Lubricating Oil Compositions

The methods and the fully formulated passenger car engine oil compositions of the methods herein including the selected base oil blend, the at least one calcium-containing hydrocarbyl-substituted sulfonate compound, and the oil-soluble molybdenum compounds as described above in a composition configured to achieve one or more of the following (a) about 0.8 weight percent or less of total measured sulfated ash as measured pursuant to ASTM D874 (wherein the calcium sulfated ash is about 80 to about 100% of the total sulfated ash content); (b) a total base number (TBN) of the lubricating oil composition, measured pursuant to ASTM D2896, of at least about 6.0 mg KOH/gram (or about 6 to about 10 mg KOH/g); (c) a high temperature high shear viscosity as measured pursuant to ASTM D4683 at 150° C. of about 1.7 to about 2.9 cSt (in other approaches, about 2.3 to about 2.6 cSt); and/or (d) an ultra-low KV100 viscosity of about 8 cSt or less (preferably, about 7.8 cSt or less, or about 7.6 or less, or about 7.4 cSt or less). Such methods and compositions are effective such that the lubricating oil composition, when lubricating a crankcase of a passenger car engine, has a positive fuel economy increase as measured pursuant to JASO M 366 (FEI adjusted) of greater than 1.1% (preferably about 1.1% to about 1.5%) and/or the lubricating oil composition has a positive fuel economy increase as measured pursuant to JASO M 365 of greater than 1.4% (preferably, about 1.5% to about 1.8% in the Japanese WLTC Mode).

In other approaches or embodiments, the methods and the passenger car engine oil compositions of the methods herein also include a weight ratio of the calcium from the at least one calcium-containing hydrocarbyl-substituted sulfonate compound to the molybdenum from the oil-soluble molybdenum compound of about 1:1 to about 2.5:1, and in other approaches, 1.2:1 to about 2:1, or about 1.2:1 to about 1.9:1 or about 1.5:1 to about 1.8:1. The methods and the passenger car engine oil compositions of the methods herein may also include embodiments with an amount of total sulfur content of at least about 2000 ppm or, in other approaches, about 2000 to about 3000 ppm total sulfur (in yet other approaches, about 2100 to about 2800 ppm total sulfur, or about 2200 to about 2600 ppm total sulfur) and may further have a weight ratio of the total sulfur to the total calcium from the at least one calcium-containing hydrocarbyl-substituted sulfonate compound of at least about 1.5:1 or greater, or at least about 1.8:1 or greater (and in other approaches, about 1.8:1 to about 2.6:1, or about 1.9:1 to about 2.5:1.)

As noted above, the methods and lubricating compositions of the methods herein are substantially free of sulfur free detergent additives and, preferably, detergent additives other than those provided by the calcium-containing hydrocarbyl-substituted sulfonate compounds. To this end, the methods and the lubricating composition of the methods herein are essentially devoid of such salicylate chemistry (e.g., less than about 100 ppm of metal-containing salicylate-based compound(s), preferably, less than about 50 ppm of metal-containing salicylate-based compound(s), more preferably, less than about 20 ppm of metal-containing salicylate-based compound(s), and more preferably, no functional amounts of metal-containing salicylate-based compound(s)). The methods and lubricating compositions of the methods herein are also preferably substantially free of magnesium, and/or sodium (e.g., less than about 500 ppm of magnesium and/or sodium), preferably, less than about 200 ppm of magnesium, and/or sodium, more preferably, less than about 100 ppm of magnesium, and/or sodium or less than about 50 ppm of magnesium and/or sodium, and more preferably, no functional amounts of magnesium, and/or sodium metals).

Optional Additives:

The methods and lubricating oil compositions of the methods herein may also include a number of optional additives combined with the at least one calcium-containing hydrocarbyl-substituted sulfonate compound and the oil-soluble molybdenum compounds as needed to meet performance standards. Those optional additives are described in the following paragraphs.

Dispersants: The lubricating oil composition may optionally include one or more other dispersants or mixtures thereof. Dispersants are often known as ashless-type dispersants because, prior to mixing in a lubricating oil composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with the number average molecular weight of the polyisobutylene substituent being in the range about 350 to about 50,000, or to about 5,000, or to about 3,000, as measured by GPC. Succinimide dispersants and their preparation are disclosed, for instance in U.S. Pat. No. 7,897,696 or U.S. Pat. No. 4,234,435. The alkenyl substituent may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

Preferred amines are selected from polyamines and hydroxylamines. Examples of polyamines that may be used include, but are not limited to, diethylene triamine (DETA), triethylene tetramine (TETA), tetraethylene pentamine (TEPA), and higher homologues such as pentacthylamine hexamine (PEHA), and the like.

A suitable heavy polyamine is a mixture of polyalkylene-polyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogen atoms per molecule and with 2 or more primary amines per molecule. The heavy polyamine comprises more than 28 wt. % (e.g. >32 wt. %) total nitrogen and an equivalent weight of primary amine groups of 120-160 grams per equivalent.

In some approaches, suitable polyamines are commonly known as PAM and contain a mixture of ethylene amines where TEPA and pentaethylene hexamine (PEHA) are the major part of the polyamine, usually less than about 80%.

Typically, PAM has 8.7-8.9 milliequivalents of primary amine per gram (an equivalent weight of 115 to 112 grams per equivalent of primary amine) and a total nitrogen content of about 33-34 wt. %. Heavier cuts of PAM oligomers with practically no TEPA and only very small amounts of PEHA but containing primarily oligomers with more than 6 nitrogen atoms and more extensive branching, may produce dispersants with improved dispersancy.

In an embodiment the present disclosure further comprises at least one polyisobutylene succinimide dispersant derived from polyisobutylene with a number average molecular weight in the range about 350 to about 50,000, or to about 5000, or to about 3000, as determined by GPC. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable, as determined by GPC. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment, the present disclosure further comprises at least one dispersant derived from polyisobutylene succinic anhydride ("PIBSA"). The PIBSA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

Unless stated otherwise, all percentages are in weight percent and all molecular weights are number average molecular weights determined by gel permeation chromatography (GPC) using commercially available polystyrene standards (with a number average molecular weight of 180 to about 18,000 as the calibration reference).

In one embodiment, the dispersant may be derived from a polyalphaolefin (PAO) succinic anhydride. In one embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

A suitable class of nitrogen-containing dispersants may be derived from olefin copolymers (OCP), more specifically, ethylene-propylene dispersants which may be grafted with maleic anhydride. A more complete list of nitrogen-containing compounds that can be reacted with the functionalized OCP are described in U.S. Pat. Nos. 7,485,603; 7,786,057; 7,253,231; 6,107,257; and 5,075,383; and/or are commercially available.

One class of suitable dispersants may also be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may also be high molecular weight esters or half ester amides. A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with: Inorganic phosphorous acids or anhydrates (e.g., U.S. Pat. Nos. 3,403,102 and 4,648,980); Organic phosphorous compounds (e.g., U.S. Pat. No. 3,502,677); Phosphorous pentasulfides; Boron compounds as already noted above (e.g., U.S. Pat. Nos. 3,178,663 and 4,652,387); Carboxylic acid, polycarboxylic acids, anhydrides and/or acid halides (e.g., U.S. Pat. Nos. 3,708,522 and 4,948,386); Epoxides polyepoxiates or thioexpoxides (e.g., U.S. Pat. Nos. 3,859,318 and 5,026,495); Aldehyde or ketone (e.g., U.S. Pat. No. 3,458,530); Carbon disulfide (e.g., U.S. Pat. No. 3,256,185); Glycidol (e.g., U.S. Pat. No. 4,617,137); Urea, thiourea or guanidine (e.g., U.S. Pat. Nos. 3,312,619; 3,865,813; and British Patent GB 1,065,595); Organic sulfonic acid (e.g., U.S. Pat. No. 3,189,544 and British Patent GB 2,140,811); Alkenyl cyanide (e.g., U.S. Pat. Nos. 3,278,550 and 3,366,569); Diketene (e.g., U.S. Pat. No. 3,546,243); A diisocyanate (e.g., U.S. Pat. No. 3,573,205); Alkane sultone (e.g., U.S. Pat. No. 3,749,695); 1,3-Dicarbonyl Compound (e.g., U.S. Pat. No. 4,579,675); Sulfate of alkoxylated alcohol or phenol (e.g., U.S. Pat. No. 3,954,639); Cyclic lactone (e.g., U.S. Pat. Nos. 4,617,138; 4,645,515; 4,668,246; 4,963,275; and 4,971,711); Cyclic carbonate or thiocarbonate linear monocarbonate or polycarbonate, or chloroformate (e.g., U.S. Pat. Nos. 4,612,132; 4,647,390; 4,648,886; 4,670,170); Nitrogen-containing carboxylic acid (e.g., U.S. Pat. No. 4,971,598 and British Patent GB 2,140,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603 and 4,666,460); Cyclic carbonate or thiocarbonate, linear monocarbonate or polycarbonate, or chloroformate (e.g., U.S. Pat. Nos. 4,612,132; 4,647,390; 4,646,860; and 4,670,170); Nitrogen-containing carboxylic acid (e.g., U.S. Pat. No. 4,971,598 and British Patent GB 2,440,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603, and 4,666,460); Cyclic carbamate, cyclic thiocarbamate or cyclic dithiocarbamate (e.g., U.S. Pat. Nos. 4,663,062 and 4,666,459); Hydroxyaliphatic carboxylic acid (e.g., U.S. Pat. Nos. 4,482,464; 4,521,318; 4,713,189); Oxidizing agent (e.g., U.S. Pat. No. 4,379,064); Combination of phosphorus pentasulfide and a polyalkylene polyamine (e.g., U.S. Pat. No. 3,185,647); Combination of carboxylic acid or an aldehyde or ketone and sulfur or sulfur chloride (e.g., U.S. Pat. Nos. 3,390,086; 3,470,098); Combination of a hydrazine and carbon disulfide (e.g. U.S. Pat. No. 3,519,564); Combination of an aldehyde and a phenol (e.g., U.S. Pat. Nos. 3,649,229; 5,030,249; 5,039,307); Combination of an aldehyde and an O-diester of dithiophosphoric acid (e.g., U.S. Pat. No. 3,865,740); Combination of a hydroxyaliphatic carboxylic acid and a boric acid (e.g., U.S. Pat. No. 4,554,086); Combination of a hydroxyaliphatic carboxylic acid, then formaldehyde and a phenol (e.g., U.S. Pat. No. 4,636,322); Combination of a hydroxyaliphatic carboxylic acid and then an aliphatic dicarboxylic acid (e.g., U.S. Pat. No. 4,663,064); Combination of formaldehyde and a phenol and then glycolic acid (e.g., U.S. Pat. No. 4,699,724); Combination of a hydroxyaliphatic carboxylic acid or oxalic acid and then a diisocyanate (e.g. U.S. Pat. No. 4,713,191); Combination of inorganic acid or anhydride of phosphorus or a partial or total sulfur analog thereof and a boron compound (e.g., U.S. Pat. No. 4,857,214); Combination of an organic diacid then an unsaturated fatty acid and then a nitrosoaromatic amine optionally followed by a boron compound and then a glycolating agent (e.g., U.S. Pat. No. 4,973,412); Combination of an aldehyde and a triazole (e.g., U.S. Pat. No. 4,963,278); Combination of an aldehyde and a triazole then a boron compound (e.g., U.S. Pat. No. 4,981,492); Combination of cyclic lactone and a boron compound (e.g., U.S. Pat. Nos. 4,963,275 and 4,971,711). The above-mentioned patents are herein incorporated in their entireties.

The TBN of a suitable dispersant may be from about 10 to about 65 mg KOH/g dispersant, on an oil-free basis, which is comparable to about 5 to about 30 TBN if measured on a dispersant sample containing about 50% diluent oil. TBN is measured by the method of ASTM D2896.

In yet other embodiments, the optional dispersant additive may be a hydrocarbyl substituted succinamide or succinimide dispersant. In approaches, the hydrocarbyl substituted succinamide or succinimide dispersant may be derived from a hydrocarbyl substituted acylating agent reacted with a polyalkylene polyamine and wherein the hydrocarbyl substituent of the succinamide or the succinimide dispersant is a linear or branched hydrocarbyl group having a number average molecular weight of about 250 to about 5,000 as measured by GPC using polystyrene as a calibration reference.

In some approaches, the polyalkylene polyamine used to form the dispersant has the Formula

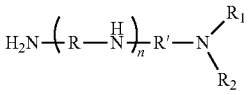

wherein each R and R', independently, is a divalent C1 to C6 alkylene linker, each $R_1$ and $R_2$, independently, is hydrogen, a C1 to C6 alkyl group, or together with the nitrogen atom to which they are attached form a 5- or 6-membered ring optionally fused with one or more aromatic or non-aromatic rings, and n is an integer from 0 to 8. In other approaches, the polyalkylene polyamine is selected from the group consisting of a mixture of polyethylene polyamines having an average of 5 to 7 nitrogen atoms, triethylenetetramine, tetraethylenepentamine, and combinations thereof.

The dispersant, if present, can be used in an amount sufficient to provide up to about 20 wt %, based upon the final weight of the lubricating oil composition. Another amount of the dispersant that can be used may be about 0.1 wt % to about 15 wt %, or about 0.1 wt % to about 10 wt %, about 0.1 to 8 wt %, or about 1 wt % to about 10 wt %, or about 1 wt % to about 8 wt %, or about 1 wt % to about 6 wt %, based upon the final weight of the lubricating oil composition. In some embodiments, the lubricating oil composition utilizes a mixed dispersant system. A single type or a mixture of two or more types of dispersants in any desired ratio may be used.

Antioxidants: The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the final weight of the lubricating oil composition. In an embodiment, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, cicosene or mixtures thereof. In one embodiment, hexadecene, heptadecene, octadecene, nonadecene, cicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

In another alternative embodiment the antioxidant composition also contains a molybdenum-containing antioxidant in addition to the phenolic and/or aminic antioxidants discussed above. When a combination of these three antioxidants is used, preferably the ratio of phenolic to aminic to molybdenum-containing component treat rates is (0 to 3): (0 to 3): (0 to 3).

The one or more antioxidant(s) may be present in ranges about 0 wt % to about 20 wt %, or about 0.1 wt % to about 10 wt %, or about 1 wt % to about 5 wt %, of the lubricating oil composition.

Antiwear Agents: The lubricating oil compositions herein also may optionally contain one or more antiwear agents. Examples of suitable antiwear agents include, but are not limited to, a metal thiophosphate; a metal dialkyldithiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. A suitable antiwear agent may be a molybdenum dithiocarbamate. The phosphorus containing antiwear agents are more fully described in European Patent 612 839. The metal in the dialkyl phosphate salts may be an alkali metal, alkaline earth metal, aluminum, lead, tin, molybdenum, manganese, nickel, copper, titanium, or zinc. A useful antiwear agent may be zinc dialkyldithiophosphate.

Further examples of suitable antiwear agents include titanium compounds, tartrates, tartrimides, oil soluble amine salts of phosphorus compounds, sulfurized olefins, (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl)disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Boron-Containing Compounds: The lubricating oil compositions herein may optionally contain one or more boron-containing compounds. Examples of boron-containing compounds include borate esters, borated fatty amines, borated epoxides, borated detergents, and borated dispersants, such as borated succinimide dispersants, as disclosed in U.S. Pat. No. 5,883,057. The boron-containing compound, if present, can be used in an amount sufficient to provide up to about 8 wt %, about 0.01 wt % to about 7 wt %, about 0.05 wt % to about 5 wt %, or about 0.1 wt % to about 3 wt % of the lubricating oil composition.

Detergents: Subject to the limitations noted above, the lubricating oil composition may optionally further comprise one or more neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein.

The detergent substrate may be salted with an alkali or alkaline earth metal such as, but not limited to, calcium, magnesium, potassium, sodium, lithium, barium, or mixtures thereof. In some embodiments, the detergent is free of barium. In some embodiments, a detergent may contain traces of other metals such as magnesium or calcium in amounts such as 50 ppm or less, 40 ppm or less, 30 ppm or less, 20 ppm or less, or 10 ppm or less. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

An overbased detergent of the lubricating oil composition may have a total base number (TBN) of about 200 mg KOH/g or greater, or as further examples, about 250 mg KOH/g or greater, or about 350 mg KOH/g or greater, or about 375 mg KOH/g or greater, or about 400 mg KOH/g or greater. The TBN being measured by the method of ASTM D2896.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased calcium phenate detergents have a total base number of at least about 150 mg KOH/g, at least about 225 mg KOH/g, at least about 225 mg KOH/g to about 400 mg KOH/g, at least about 225 mg KOH/g to about 350 mg KOH/g or about 230 mg KOH/g to about 350 mg KOH/g, all as measured by the method of ASTM D2896. When such detergent compositions are formed in an inert diluent, e.g. a process oil, usually a mineral oil, the total base number reflects the basicity of the overall composition including diluent, and any other materials (e.g., promoter, etc.) that may be contained in the detergent composition.

The overbased detergent may have a metal to substrate ratio of from 1.1:1, or from 2:1, or from 4:1, or from 5:1, or from 7:1, or from 10:1. In some embodiments, a detergent is effective at reducing or preventing rust in an engine or other automotive part such as a transmission or gear. The detergent may be present in a lubricating composition at about 0 wt % to about 10 wt %, or about 0.1 wt % to about 8 wt %, or about 1 wt % to about 4 wt %, or greater than about 4 wt % to about 8 wt %.

Extreme Pressure Agents: The lubricating oil compositions herein also may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated wax; organic sulfides and polysulfides such as dibenzyldisulfide, bis(chlorobenzyl)disulfide, dibutyl tetrasulfide, sulfurized methyl ester of oleic acid, sulfurized alkyl phenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers: The lubricating oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a diester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an olcophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

A friction modifier may optionally be present in ranges such as about 0 wt % to about 10 wt %, or about 0.01 wt % to about 8 wt %, or about 0.1 wt % to about 4 wt %.

Other Molybdenum-containing components: The lubricating oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan® 822, Molyvan® A, Molyvan® 2000 and Molyvan® 855 from R. T. Vanderbilt Co., Ltd., and Adeka Sakura-Lube® S-165, S-200, S-300, S-310G, S-525, S-600, S-700, and S-710 available from Adeka Corporation, and mixtures thereof. Suitable molybdenum components are described in U.S. Pat. No. 5,650,381; US RE 37,363 E1; US RE 38,929 E1; and US RE 40,595 E1, incorporated herein by reference in their entireties.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $MO_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula $Mo_3S_kL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms.

Additional suitable molybdenum compounds are described in U.S. Pat. No. 6,723,685, herein incorporated by reference in its entirety.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum.

Transition Metal-containing compounds: In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, an oil-soluble transition metal-containing compound may function as antiwear agents, friction modifiers, antioxidants, deposit control additives, or more than one of these functions. In an embodiment the oil-soluble transition metal-containing compound may be an oil-soluble titanium compound, such as a titanium (IV) alkoxide. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV)alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato) isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl-(or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl-(or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and $C_6$ to $C_{25}$ carboxylic acid. The reaction product may be represented by the following formula:

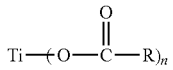

wherein n is an integer selected from 2, 3 and 4, and R is a hydrocarbyl group containing from about 5 to about 24 carbon atoms, or by the formula:

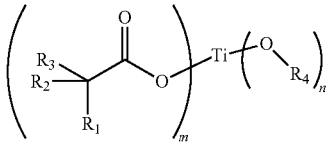

wherein m+n=4 and n ranges from 1 to 3, $R_4$ is an alkyl moiety with carbon atoms ranging from 1-8, $R_1$ is selected from a hydrocarbyl group containing from about 6 to 25 carbon atoms, and $R_2$ and $R_3$ are the same or different and are selected from a hydrocarbyl group containing from about 1 to 6 carbon atoms, or the titanium compound may be represented by the formula:

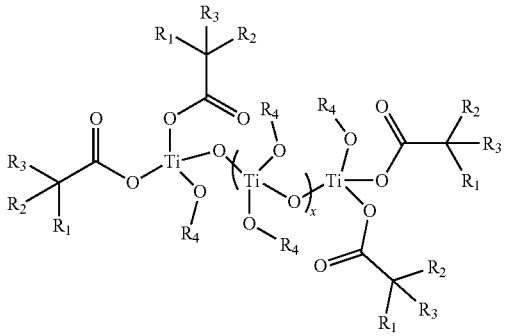

wherein x ranges from 0 to 3, $R_1$ is selected from a hydrocarbyl group containing from about 6 to 25 carbon atoms, $R_2$, and $R_3$ are the same or different and are selected from a hydrocarbyl group containing from about 1 to 6 carbon atoms, and $R_4$ is selected from a group consisting of either H, or $C_6$ to $C_{25}$ carboxylic acid moiety.

Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the lubricating oil composition in an amount to provide from 0 to 3000 ppm titanium by weight or 25 to about 1500 ppm titanium by weight or about 35 ppm to 500 ppm titanium by weight or about 50 ppm to about 300 ppm.

Viscosity Index Improvers: The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, of the lubricating oil composition.

Other Optional Additives: Other additives may be selected to perform one or more functions required of a lubricating fluid. Further, one or more of the mentioned additives may be multi-functional and provide functions in addition to or other than the function prescribed herein.

A lubricating oil composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid.

The rust inhibitor, if present, can be used in an amount sufficient to provide about 0 wt % to about 5 wt %, about 0.01 wt % to about 3 wt %, about 0.1 wt % to about 2 wt %, based upon the final weight of the lubricating oil composition.

In general terms, a suitable lubricant including the detergent metals herein may include additive components in the ranges listed in the following table.

TABLE 2

Suitable Lubricating Compositions

| Component | Wt. % (Suitable Embodiments) | Wt. % (Suitable Embodiments) |
|---|---|---|
| Sulfonate-based Compound(s) | 0.1-5.0 | 0.15-3.0 |
| Oil-Soluble molybdenum Compound(s) | 0.1-1.0 | 0.5-0.8 |
| Antioxidant(s) | 0.1-5.0 | 0.01-3.0 |
| Other Detergent(s) | 0.0-15.0 | 0.2-8.0 |
| Ashless TBN booster(s) | 0.0-1.0 | 0.01-0.5 |
| Corrosion inhibitor(s) | 0.0-5.0 | 0.0-2.0 |
| Metal dihydrocarbyldithiophosphate(s) | 0.0-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |
| Viscosity index improver(s) | 0.0-25.0 | 0.1-15.0 |
| Dispersant viscosity index improver(s) | 0.0-10.0 | 0.0-5.0 |
| Friction modifier(s) | 0.00-5.0 | 0.01-2.0 |
| Base oil | Balance | Balance |
| Total | 100 | 100 |

The percentages of each component above represent the weight percent of each component, based upon the weight of the final lubricating oil composition. The remainder of the lubricating oil composition consists of one or more base oils. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). Fully formulated lubricants conventionally contain an additive package, referred to herein as a dispersant/inhibitor package or DI package, that will supply the characteristics that are required in the formulation.

Definitions

For purposes of this disclosure, the chemical elements are identified in accordance with the Periodic Table of the Elements, CAS version, Handbook of Chemistry and Physics, 75th Ed. Additionally, general principles of organic chemistry are described in "Organic Chemistry", Thomas Sorrell, University Science Books, Sausolito: 1999, and "March's Advanced Organic Chemistry", 5th Ed., Ed.: Smith, M. B. and March, J., John Wiley & Sons, New York: 2001, the entire contents of which are hereby incorporated by reference.

As described herein, compounds may optionally be substituted with one or more substituents, such as are illustrated generally above, or as exemplified by particular classes, subclasses, and species of the disclosure.

Unless otherwise apparent from the context, the term "major amount" is understood to mean an amount greater than or equal to 50 weight percent, for example, from about 80 to about 98 weight percent relative to the total weight of the composition. Moreover, as used herein, the term "minor amount" is understood to mean an amount less than 50 weight percent relative to the total weight of the composition.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include: (1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); (2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy); (3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein the term "aliphatic" encompasses the terms alkyl, alkenyl, alkynyl, each of which being optionally substituted as set forth below.

As used herein, an "alkyl" group refers to a saturated aliphatic hydrocarbon group containing 1-12 (e.g., 1-8, 1-6, or 1-4) carbon atoms. An alkyl group can be straight or branched. Examples of alkyl groups include, but are not limited to, methyl, ethyl, propyl, isopropyl, butyl, isobutyl, sec-butyl, tert-butyl, n-pentyl, n-heptyl, or 2-ethylhexyl. An alkyl group can be substituted (i.e., optionally substituted) with one or more substituents such as halo, phospho, cycloaliphatic [e.g., cycloalkyl or cycloalkenyl], heterocycloaliphatic [e.g., heterocycloalkyl or heterocycloalkenyl], aryl, heteroaryl, alkoxy, aroyl, heteroaroyl, acyl [e.g., (aliphatic) carbonyl, (cycloaliphatic) carbonyl, or (heterocycloaliphatic) carbonyl], nitro, cyano, amido [e.g., (cycloalkylalkyl) carbonylamino, arylcarbonylamino, aralkylcarbonylamino, (heterocycloalkyl) carbonylamino, (heterocycloalkylalkyl) carbonylamino, heteroarylcarbonylamino, heteroaralkyl carbonylamino alkylaminocarbonyl, cycloalkylaminocarbonyl, heterocycloalkylaminocarbonyl, arylaminocarbonyl, or heteroarylaminocarbonyl], amino [e.g., aliphaticamino, cycloaliphatic amino, or heterocycloaliphaticamino], sulfonyl [e.g., aliphatic-$SO_2$—], sulfinyl, sulfanyl, sulfoxy, urea, thiourea, sulfamoyl, sulfamide, oxo, carboxy, carbamoyl, cycloaliphaticoxy, heterocyclo aliphaticoxy, aryloxy, heteroaryloxy, aralkyloxy, heteroarylalkoxy, alkoxycarbonyl, alkyl carbonyloxy, or hydroxy. Without limitation, some examples of substituted alkyls include carboxyalkyl (such as HOOC-alkyl, alkoxycarbonylalkyl, and alkylcarbonyloxyalkyl), cyanoalkyl, hydroxyalkyl, alkoxyalkyl, acylalkyl, aralkyl, (alkoxyaryl) alkyl, (sulfonylamino) alkyl (such as (alkyl-$SO_2$-amino) alkyl), aminoalkyl, amidoalkyl, (cycloaliphatic)alkyl, or haloalkyl.

As used herein, an "alkenyl" group refers to an aliphatic carbon group that contains 2-8 (e.g., 2-12, 2-6, or 2-4) carbon atoms and at least one double bond. Like an alkyl group, an alkenyl group can be straight or branched. Examples of an alkenyl group include, but are not limited to allyl, isoprenyl, 2-butenyl, and 2-hexenyl. An alkenyl group can be optionally substituted with one or more substituents such as halo, phospho, cycloaliphatic [e.g., cycloalkyl or cycloalkenyl], heterocycloaliphatic [e.g., heterocycloalkyl or hetero cycloalkenyl], aryl, heteroaryl, alkoxy, aroyl, heteroaroyl, acyl [e.g., (aliphatic) carbonyl, (cycloaliphatic) carbonyl, or (heterocycloaliphatic) carbonyl], nitro, cyano, amido [e.g., (cycloalkylalkyl) carbonylamino, arylcarbonylamino, aralkylcarbonylamino, (hetero cycloalkyl) carbonylamino, (heterocyclo alkylalkyl) carbonylamino, heteroarylcarbonylamino, heteroaralkylcarbonylamino alkylamino carbonyl, cycloalkylaminocarbonyl, hetero cyclo alkylaminocarbonyl, arylaminocarbonyl, or heteroarylaminocarbonyl], amino [e.g., aliphaticamino, cycloaliphaticamino, heterocyclo aliphaticamino, or aliphaticsulfonylamino], sulfonyl [e.g., alkyl-$SO_2$—, cycloaliphatic-$SO_2$—, or aryl-$SO_2$—], sulfinyl, sulfanyl, sulfoxy, urea, thiourea, sulfamoyl, sulfamide, oxo, carboxy, carbamoyl, cycloaliphaticoxy, heterocycloaliphaticoxy, aryloxy, heteroaryloxy, aralkyloxy, heteroaralkoxy, alkoxycarbonyl, alkylcarbonyloxy, or hydroxy. Without limitation, some examples of substituted alkenyls include cyanoalkenyl, alkoxyalkenyl, acylalkenyl, hydroxyl alkenyl, aralkenyl, (alkoxyaryl)alkenyl, (sulfonylamino)alkenyl (such as (alkyl-$SO_2$-amino)alkenyl), aminoalkenyl, amidoalkenyl, (cycloaliphatic)alkenyl, or haloalkenyl.

As used herein, an "alkynyl" group refers to an aliphatic carbon group that contains 2-8 (e.g., 2-12, 2-6, or 2-4) carbon atoms and has at least one triple bond. An alkynyl group can be straight or branched. Examples of an alkynyl group include, but are not limited to, propargyl and butynyl. An alkynyl group can be optionally substituted with one or more substituents such as aroyl, heteroaroyl, alkoxy, cycloalkyloxy, heterocycloalkyloxy, aryloxy, heteroaryloxy, aralkyl oxy, nitro, carboxy, cyano, halo, hydroxy, sulfo, mercapto, sulfanyl [e.g., aliphaticsulfanyl or cycloaliphaticsulfanyl], sulfinyl [e.g., aliphaticsulfinyl or cycloaliphaticsulfinyl], sulfonyl [e.g., aliphatic-$SO_2$-, aliphaticamino-$SO_2$—, or cycloaliphatic-$SO_2$—], amido [e.g., aminocarbonyl, alkylaminocarbonyl, alkylcarbonylamino, cyclo alkylaminocarbonyl, heterocycloalkylaminocarbonyl, cycloalkylcarbonylamino, arylamino carbonyl, arylcarbonylamino, aralkylcarbonylamino, (heterocycloalkyl) carbonylamino, (cycloalkylalkyl) carbonylamino, heteroaralkylcarbonylamino, heteroaryl carbonylamino or heteroaryl amino carbonyl], urea, thiourea, sulfamoyl, sulfamide, alkoxycarbonyl, alkyl carbonyloxy, cyclo aliphatic, heterocycloaliphatic, aryl, heteroaryl, acyl [e.g., (cycloaliphatic) carbonyl or (hetero cyclo aliphatic) carbonyl], amino [e.g., aliphaticamino], sulfoxy, oxo, carboxy, carbamoyl, (cycloaliphatic)oxy, (heterocyclo aliphatic)oxy, or (heteroaryl)alkoxy.

As used herein, an "amino" group refers to $-NR^XR^Y$ wherein each of $R^X$ and $R^Y$ is independently hydrogen, alkyl, cycloakyl, (cycloalkyl)alkyl, aryl, aralkyl, heterocycloalkyl, (heterocycloalkyl)alkyl, heteroaryl, carboxy, sulfanyl, sulfinyl, sulfonyl, (alkyl) carbonyl, (cycloalkyl) carbonyl, ((cycloalkyl)alkyl) carbonyl, arylcarbonyl, (aralkyl) carbonyl, (heterocyclo alkyl) carbonyl, ((heterocycloalkyl)alkyl) carbonyl, (heteroaryl) carbonyl, or (heteroaralkyl) carbonyl, each of which being defined herein and being optionally substituted. Examples of amino groups include alkylamino, dialkylamino, or arylamino. When the term "amino" is not the terminal group (e.g., alkylcarbonylamino), it is represented by $—NR^X—$. $R^X$ has the same meaning as defined above.

As used herein, a "cycloalkyl" group refers to a saturated carbocyclic mono- or bicyclic (fused or bridged) ring of 3-10 (e.g., 5-10) carbon atoms. Examples of cycloalkyl groups include cyclopropyl, cyclobutyl, cyclopentyl, cyclohexyl, cycloheptyl, adamantyl, norbornyl, cubyl, octahydroindenyl, decahydro-naphthyl, bicyclo[3.2.1]octyl, bicyclo[2.2.29octyl, bicyclo[3.3.1]nonyl, bicyclo[3.3.2.]decyl, bicyclo[2.2.2]octyl, adamantyl, or ((aminocarbonyl)cycloalkyl)cycloalkyl.

As used herein, a "heterocycloalkyl" group refers to a 3-10 membered mono- or bicylic (fused or bridged) (e.g., 5- to 10-membered mono- or bicyclic) saturated ring structure, in which one or more of the ring atoms is a heteroatom (e.g., N, O, S, or combinations thereof). Examples of a heterocycloalkyl group include piperidyl, piperazyl, tetrahydropyranyl, tetrahydrofuryl, 1,4-dioxolanyl, 1,4-dithianyl, 1,3-dioxolanyl, oxazolidyl, isoxazolidyl, morpholinyl, thiomorpholyl, octahydrobenzofuryl, octahydrochromenyl, octahydrothio chromenyl, octahydroindolyl, octahydropyrindinyl, decahydroquinolinyl, octahydrobenzo[b]thiophencyl, 2-oxa-bicyclo[2.2.2]octyl, 1-aza-bicyclo[2.2.2]octyl, 3-aza-bicyclo[3.2.1] octyl, and 2,6-dioxa-tricyclo[3.3.1.0] nonyl. A monocyclic heterocycloalkyl group can be fused with a phenyl moiety to form structures, such as tetrahydroisoquinoline, which would be categorized as heteroaryls.

A "heteroaryl" group, as used herein, refers to a monocyclic, bicyclic, or tricyclic ring system having 4 to 15 ring atoms wherein one or more of the ring atoms is a heteroatom (e.g., N, O, S, or combinations thereof) and in which the monocyclic ring system is aromatic or at least one of the rings in the bicyclic or tricyclic ring systems is aromatic. A heteroaryl group includes a benzofused ring system having 2 to 3 rings. For example, a benzofused group includes benzo fused with one or two 4 to 8 membered heterocycloaliphatic moieties (e.g., indolizyl, indolyl, isoindolyl, 3H-indolyl, indolinyl, benzo[b]furyl, benzo[b]thiophenyl, quinolinyl, or isoquinolinyl). Some examples of heteroaryl are pyridyl, 1H-indazolyl, furyl, pyrrolyl, thienyl, thiazolyl, oxazolyl, imidazolyl, tetrazolyl, benzofuryl, isoquinolinyl, benzthiazolyl, xanthene, thioxanthene, phenothiazine, dihydroindole, benzo[1,3]dioxole, benzo[b]furyl, benzo[b]thiophenyl, indazolyl, benzimidazolyl, benzthiazolyl, puryl, cinnolyl, quinolyl, quinazolyl, cinnolyl, phthalazyl, quinazolyl, quinoxalyl, isoquinolyl, 4H-quinolizyl, benzo-1,2,5-thiadiazolyl, or 1,8-naphthyridyl.

Without limitation, monocyclic heteroaryls include furyl, thiophenyl, 2H-pyrrolyl, pyrrolyl, oxazolyl, thazolyl, imidazolyl, pyrazolyl, isoxazolyl, isothiazolyl, 1,3,4-thiadiazolyl, 2H-pyranyl, 4-H-pranyl, pyridyl, pyridazyl, pyrimidyl, pyrazolyl, pyrazyl, or 1,3,5-triazyl. Monocyclic heteroaryls are numbered according to standard chemical nomenclature.

Without limitation, bicyclic heteroaryls include indolizyl, indolyl, isoindolyl, 3H-indolyl, indolinyl, benzo[b]furyl, benzo[b]thiophenyl, quinolinyl, isoquinolinyl, indolizinyl, isoindolyl, indolyl, benzo[b]furyl, bexo [b]thiophenyl, indazolyl, benzimidazyl, benzthiazolyl, purinyl, 4H-quinolizyl, quinolyl, isoquinolyl, cinnolyl, phthalazyl, quinazolyl, quinoxalyl, 1,8-naphthyridyl, or pteridyl. Bicyclic heteroaryls are numbered according to standard chemical nomenclature.

As used herein, the term "treat rate" refers to the weight percent of a component in the lubricating and cooling fluids.

The weight average molecular weight (Mw) and/or the number average molecular weight (Mn) may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5 u, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available poly(methyl methacrylate) (PMMA) standards having a narrow molecular weight distribution ranging from 960-1,568,000 g/mol. The calibration curve can be extrapolated for samples having a mass less than 500 g/mol. Samples and PMMA standards can be in dissolved in THF and prepared at concentration of 0.1 to 0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

EXAMPLES

A better understanding of the present disclosure and its many advantages may be clarified with the following examples. The following examples are illustrative and not limiting thereof in either scope or spirit. Those skilled in the art will readily understand that variations of the components, methods, steps, and devices described in these examples can be used. Unless noted otherwise or apparent from the context of discussion in the Examples below and throughout this disclosure, all percentages, ratios, and parts noted in this disclosure are by weight. Any standardized test method noted in the Examples, disclosure, or claims, unless apparent from the context of its use, refers to the version of the test method publically available at the time of the filing of the present disclosure.

Example 1

An Inventive and a Comparative lubricating composition were each evaluated for fuel economy improvement pursuant to the motored engine test of JASO M 365. The Inventive lubricating composition of this Example included about 1160 ppm of calcium provided by a hydrocarbyl-substituted sulfonate compound and the Comparative lubricating composition of this Example provided about 1160 ppm of calcium from a salicylate compound. The calcium sulfonate compound in the Inventive composition was an overbased hydrocarbyl-substituted calcium sulfonate having a TBN of about 300 mg KOH/gram, about 11.9% calcium, and a hydrocarbyl substituent derived from a blend of C14 to C26 olefins having a number average molecular weight between about 250 to about 300. The calcium salicylate compound in the Comparative composition had a TBN of about 177 mg KOH/gram, about 6.6 percent calcium, and a hydrocarbyl substituent derived from a blend of C14 to C18 olefins. Each Inventive and Comparative composition was also combined with a molybdenum dialkyl dithiocarbamate compound and/or an organomolybdenum nitrogen complex as the oil-soluble molybdenum compound providing the total amount of molybdenum to each of the Inventive and Comparative compositions.

The compositions all had similar additive packages of dispersants, antiwear additives, aminic antioxidants, phenolic antioxidants, friction modifiers, antifoam agents, pour point depressants and process oil. The Inventive and Comparative compositions also had about 600 ppm of phosphorus, about 2500 ppm of sulfur, about 150 ppm of boron, and about 650 ppm of zinc. The Inventive and Comparative lubricating compositions each included a base oil selected from Group III base oils of about 4 to about 8 cSt. The only material change between the Inventive and Comparative samples was the sulfonate compound versus the salicylate compound.

Table 3 below provides further details on the Inventive and Comparative lubricants including the JASO fuel economy improvements of each. Fuel economy was conducted for this Example pursuant to the motored fuel economy test of JASO M 365 using a Nissan MR20DD 2.0 L engine (e.g., a Nissan Sentra or like with a 1997 cc in-line 4-cylinder 16 valve engine with direct injection and twin variable valve timing control) and measured using the Japanese WLTC Mode.

TABLE 3

| Fluid Relationships and M 365 Performance | | |
|---|---|---|
| | Inventive 1 | Comparative 1 |
| Calcium-Sulfonate Compound, ppm Ca | 1160 | — |
| Calcium-Salicylate Compound, ppm Ca | — | 1160 |
| Oil-soluble Molybdenum compound(s), ppm Mo | 1000 | 1000 |
| KV100 (ASTM D445), cSt | 7.39 | 7.57 |
| HTHS 150 (ASTM D4683), cSt | 2.8 | 2.6 |
| TBN from Calcium compound (ASTM D2896), mg KOH/g | 3.0 | 3.1 |
| Total TBN (ASTM D2896), mg KOH/g | 6.4 | 7.0 |
| Calcium SASH (ASTM D874), % wt. | 0.4 | 0.4 |
| Total SASH (ASTM D874), % wt. | 0.7 | 0.7 |
| Calcium-to-Molybdenum ratio (Ca/Mo) | 1.2 | 1.2 |

TABLE 3-continued

| Fluid Relationships and M 365 Performance | | |
|---|---|---|
| | Inventive 1 | Comparative 1 |
| JASO M 365 fuel economy improvement— Japanese WLTC Mode (%) | 1.5 | 1.3 |
| | PASS | FAIL |

As shown in Table 3 above, lubricants including calcium provided by salicylate compound could not pass the M 365 fuel improvement tests, but methods including a lubricant including the selected hydrocarbyl-substituted calcium sulfonate compound combined with the oil-soluble molybdenum compound was unexpectedly able to pass the M 365 fuel improvement tests.

Example 2

An Inventive and a Comparative lubricating composition were each evaluated for fuel economy improvement pursuant to the fired engine test of JASO M 366. The Inventive lubricating composition included about 1200 ppm of calcium provided by a hydrocarbyl-substituted sulfonate compound and the Comparative lubricating composition provided about 1200 ppm of calcium from a calcium salicylate compound. The hydrocarbyl-substituted calcium sulfonate compound in the Inventive composition was an overbased calcium sulfonate having a TBN of about 300 mg KOH/gram, about 11.9% calcium, and a hydrocarbyl substituent derived from a blend of C14 to C26 olefins having a number average molecular weight of about 250 to about 300 g/mol. The calcium salicylate compound in the Comparative composition had a TBN of about 177 mg KOH/gram, about 6.6 percent calcium, and a hydrocarbyl substituent derived from a blend of C14 to C18 olefins. Each composition was also combined with a molybdenum dialkyl dithiocarbamate compound and/or an organomolybdenum nitrogen complex providing a total amount of molybdenum to each of the inventive and comparative compositions.

The compositions all had a similar additive packages of a dispersants, antiwear additives, aminic antioxidants, phenolic antioxidants, friction modifiers, antifoam agents, pour point depressants and process oil. The inventive and comparative compositions also had about 600 ppm of phosphorus, about 2200 ppm of sulfur, about 100 ppm of boron, and about 700 ppm of zinc. The Inventive and Comparative lubricating each included a base oil blend selected from Group III base oils of about 4 to about 8 cSt. The only material change between the Inventive and Comparative samples was the sulfonate compound versus the salicylate compound.

Table 4 below provides further details on the Inventive and Comparative lubricants including the JASO fuel economy improvements. Fuel economy was conducted pursuant to JASO M 366 using a Toyota 2ZR-FXE engine (e.g., Toyota Prius or the like with a 1.8 liter, inline 5, port fuel injection.)

TABLE 4

| Fluid Relationships and M 366 Performance | | |
|---|---|---|
| | Inventive 2 | Comparative |
| Calcium-sulfonate Compound, ppm Ca | 1200 | — |
| Calcium-salicylate Compound, ppm Ca | — | 1200 |

TABLE 4-continued

| Fluid Relationships and M 366 Performance | Inventive 2 | Comparative |
|---|---|---|
| Oil-soluble Molybdenum compound, ppm Mo | 650 | 650 |
| KV100 (ASTM D445), cSt | 6.34 | 6.53 |
| HTHS 150 (ASTM D4683), cSt | 2.4 | 2.3 |
| TBN from Calcium compound (ASTM D2896), mg KOH/g | 3.1 | 3.2 |
| Total TBN (ASTM D2896), mg KOH/g | 6.6 | 7.3 |
| Calcium SASH (ASTM D874), % wt. | 0.4 | 0.4 |
| Total SASH (ASTM D874), % wt. | 0.7 | 0.7 |
| Calcium-to-Molybdenum ratio (Ca/Mo) | 1.8 | 1.8 |
| JASO M 366 fuel economy improvement—FEI adjusted (%) | 1.1 | 0.7 |
| | PASS | FAIL |

As shown in Table 4 above, a lubricant including calcium provided by salicylate could not pass the M 366 fuel improvement tests, but a lubricant including the selected hydrocarbyl-substituted calcium sulfonate compound combined with the oil-soluble molybdenum compound was unexpectedly able to pass the M 366 fuel improvement tests.

Example 3

A further Comparative lubricating composition was evaluated for fuel economy improvement pursuant to the motored engine test of JASO M 365. The Comparative lubricating composition of this Example used magnesium sulfonate instead of calcium sulfonate and provided about 1000 ppm of magnesium from a hydrocarbyl substituted magnesium sulfonate compound. The magnesium sulfonate compound was an overbased hydrocarbyl-substituted magnesium sulfonate having a TBN of about 400 mg KOH/gram, about 9.6% magnesium, and a hydrocarbyl substituent derived from a blend of C14 to C26 olefins having a number average molecular weight between about 250 to about 300. Similar to the other Examples, the Comparative composition of this Example was also combined with a molybdenum dialkyl dithiocarbamate compound and/or an organomolybdenum nitrogen complex providing a total amount of molybdenum. The composition also had a similar additive package as the compositions of Example 1 including dispersants, antiwear additives, aminic antioxidants, phenolic antioxidants, friction modifiers, antifoam agents, pour point depressants and process oil. The comparative composition of this Example also had about 600 ppm of phosphorus, about 2500 ppm of sulfur, about 150 ppm of boron, and about 650 ppm of zinc. The Comparative lubricating included a base oil selected from Group III base oils of about 4 to about 8 cSt.

Table 5 below provides further details on the Comparative lubricant of this Example including the JASO fuel economy improvements. Fuel economy was conducted for this Example pursuant to the motored fuel economy test of JASO M 365 using a Nissan MR20DD 2.0 L engine (e.g., a Nissan Sentra or like with a 1997 cc in-line 4-cylinder 16 valve engine with direct injection and twin variable valve timing control).

TABLE 5

| Fluid Relationships and M 365 Performance | Comparative 5 |
|---|---|
| Calcium-Sulfonate Compound, ppm Ca | — |
| Calcium-Salicylate Compound, ppm Ca | — |
| Magnesium-Sulfonate Compound, ppm Mg | 1000 |

TABLE 5-continued

| Fluid Relationships and M 365 Performance | Comparative 5 |
|---|---|
| Oil-soluble Molybdenum compound(s), ppm Mo | 1000 |
| KV100 (ASTM D445), cSt | 7.4 |
| HTHS 150 (ASTM D4683), cSt | 2.6 |
| TBN from Calcium compound (ASTM D2896), mg KOH/g | — |
| TBN from Magnesium compound (ASTM D2896), mg KOH/g | 5.0 |
| Total TBN (ASTM D2896), mg KOH/g | 8.0 |
| Calcium SASH (ASTM D874), % wt. | — |
| Magnesium SASH (ASTM D874), % wt. | 0.6 |
| Total SASH (ASTM D874), % wt. | 0.8 |
| JASO M 365 fuel economy improvement—Japanese WLTC Mode (%) | 1.4 |
| | FAIL |

As shown in Table 5 above, lubricants including magnesium provided by a sulfonate compound could not pass the M 365 fuel improvement tests even when combined with the oil-soluble molybdenum compounds of Example 1. Thus, comparing the results of Example 1 to this Example, comparable amounts of metal provided by a magnesium sulfonate unexpectedly could not achieve the same passing M 365 fuel economy performance as compared to a composition including calcium sulfonate compounds.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A method of improving the fuel economy of a passenger car engine using a lubricating oil composition, the method comprising:

lubricating an engine crankcase of a passenger car engine with a lubricating oil composition and achieving a positive fuel economy increase when fuel economy is measured pursuant to one or both of JASO M 366 and/or JASO M 365;

wherein the lubricating oil composition includes (i) at least one calcium-containing hydrocarbyl-substituted sulfonate compound providing about 900 ppm or more calcium to the lubricating oil composition, wherein the hydrocarbyl moiety thereof has a number average molecular weight of about 80 to about 300 g/mol, (ii) at least one oil soluble molybdenum compound providing about 500 to about 1200 ppm molybdenum to the lubricating oil composition; (iii) a total measured sulfated ash about 0.8 weight percent or less as measured pursuant to ASTM D874; (iv) a total base number (TBN) of the lubricating oil composition, measured pursuant to ASTM D2896, of at least about 6.0 mg KOH/gram; and (v) a high temperature high shear viscosity as measured pursuant to ASTM D4683 at 150° C. of about 1.7 to about 2.9 cSt; and wherein the lubricating oil composition is essentially devoid of sulfur-free detergents, the lubricating oil composition is substantially free of magnesium-containing detergents, and the lubricating oil composition contains less than 50 ppm of magnesium.

2. The method of claim 1, wherein the lubricating oil composition has a positive fuel economy increase as measured pursuant to JASO M 366 of greater than 1.1%.

3. The method of claim 1, wherein the lubricating oil composition has a positive fuel economy increase as measured pursuant to JASO M 365 of greater than 1.5% (Japanese WLTC Mode).

4. The method of claim 1, wherein the calcium-containing hydrocarbyl-substituted sulfonate compound provides up to about 1500 ppm of calcium.

5. The method of claim 1, wherein the calcium-containing hydrocarbyl-substituted sulfonate compound has a total base number (TBN) measured pursuant to ASTM D2896 of at least about 175 mg KOH/gram.

6. The method of claim 5, wherein the hydrocarbyl moiety of the calcium-containing hydrocarbyl-substituted sulfonate component includes a linear or branched $C_6$ to $C_{30}$ hydrocarbyl group.

7. The method of claim 1, wherein the sulfur-free detergent includes a metal-containing salicylate detergent.

8. The method of claim 1, wherein the lubricating oil composition has a weight ratio of calcium-to-molybdenum of about 1:1 to about 2:1.

9. The method of claim 1, wherein the oil-soluble molybdenum compound is selected from molybdenum dithiocarbamates, molybdenum dialkyl dithiophosphates, molybdenum sulfides, molybdenum disulfides, molybdenum dithiophosphinates, amine salts of molybdenum compounds, organomolybdenum nitrogen complexes, molybdenum xanthates, molybdenum thioxanthates, molybdenum sulfides, molybdenum carboxylates, molybdenum alkoxides, a trinuclear organo-molybdenum compound, complexes thereof, esters thereof, and/or mixtures thereof.

10. The method of claim 9, wherein the lubricating oil composition has a weight ratio of calcium-to-molybdenum of about 1:1 to about 2:1.

11. The method of claim 1, wherein the lubricating oil composition is essentially devoid of one or more of metal salts of phenates, metal salts of calixarates, metal salts of salixarates, metal salts of salicylates, metal salts of carboxylic acids, or combinations thereof.

12. The method of claim 1, wherein the lubricating oil composition is substantially free of organic friction modifiers.

13. The method of claim 1, wherein the lubricating oil composition has a KV100 of about 8 cSt or lower.

14. A passenger car engine lubricating oil composition configured to achieve positive fuel economy improvement pursuant to JASO M 366 and/or JASO M 365, the composition comprising:

at least one calcium-containing hydrocarbyl-substituted sulfonate compound providing about 900 ppm or more calcium to the lubricating oil composition, wherein the hydrocarbyl moiety thereof having a number average molecular weight of about 80 to 300 g/mol;

at least one oil soluble molybdenum compound providing about 500 to about 1200 ppm molybdenum to the lubricating oil composition;

a total measured sulfated ash about 0.8 weight percent or less as measured pursuant to ASTM D874;

a total base number (TBN) of the lubricating oil composition, measured pursuant to ASTM D2896, of at least about 6.0 mg KOH/gram;

a high temperature high shear viscosity as measured pursuant to ASTM D4683 at 150° C. of about 1.7 to about 2.9 cSt; and wherein the lubricating oil composition has a weight ratio of calcium-to-molybdenum of about 1:1 to about 2:1, the lubricating oil composition is essentially devoid of sulfur-free detergents, the lubricating oil composition is substantially free of magnesium-containing detergents, and the lubricating oil composition contains less than 50 ppm of magnesium.

15. The composition of claim 14, wherein the lubricating oil composition has a positive fuel economy increase as measured pursuant to JASO M 366 of greater than 1.1%.

16. The composition of claim 14, wherein the lubricating oil composition has a positive fuel economy increase as measured pursuant to JASO M 365 of greater than 1.5% (Japanese WLTC Mode).

17. The composition of claim 14, wherein the calcium-containing hydrocarbyl-substituted sulfonate compound provides up to about 1500 ppm of calcium.

18. The composition of claim 17, wherein the calcium-containing hydrocarbyl-substituted sulfonate compound includes a hydrocarbyl moiety derived from $C_{14}$ to $C_{30}$ olefins.

19. The composition of claim 14, herein the lubricating oil composition is essentially devoid of one or more of metal salts of phenates, metal salts of calixarates, metal salts of salixarates, metal salts of salicylates, metal salts of carboxylic acids, or combinations thereof.

* * * * *